US008419498B2

(12) United States Patent
Furusawa et al.

(10) Patent No.: US 8,419,498 B2
(45) Date of Patent: Apr. 16, 2013

(54) VEHICLE TOY

(75) Inventors: Hokuto Furusawa, Tokyo (JP); Shotaro Matsuno, Tokyo (JP); Katsuyuki Miyazawa, Tokyo (JP)

(73) Assignee: Bandai Co., Ltd., Tokyo (JP)

( * ) Notice: Subject to any disclaimer, the term of this patent is extended or adjusted under 35 U.S.C. 154(b) by 194 days.

(21) Appl. No.: 12/662,280

(22) Filed: Apr. 8, 2010

(65) Prior Publication Data

US 2011/0070801 A1 Mar. 24, 2011

(30) Foreign Application Priority Data

Sep. 24, 2009 (JP) ..... 2009-218376

(51) Int. Cl.
*A63H 33/00* (2006.01)

(52) U.S. Cl.
USPC ..... 446/71; 446/470

(58) Field of Classification Search ..... 446/71, 446/470
See application file for complete search history.

(56) References Cited

U.S. PATENT DOCUMENTS

| | | | | |
|---|---|---|---|---|
| 4,382,347 | A | 5/1983 | Murakami | |
| 4,680,018 | A | 7/1987 | Ohno | |
| 5,362,271 | A * | 11/1994 | Butt | 446/139 |
| 6,749,482 | B1 * | 6/2004 | Hollis et al. | 446/466 |
| 2009/0209168 | A1 | 8/2009 | Ejima | |

FOREIGN PATENT DOCUMENTS

| | | | |
|---|---|---|---|
| CN | 201 171 907 | Y | 12/2008 |
| JP | 58-036580 | A | 3/1983 |
| JP | 60-55491 | | 4/1985 |
| JP | 1-17708 | B2 | 3/1989 |
| JP | 3-30390 | | 4/1991 |
| JP | 3047055 | | 1/1998 |
| JP | 3047055 | * | 10/1998 |

OTHER PUBLICATIONS

The extended European search report issued on Apr. 25, 2012 and an International Search Report.
Korean Office Action issued on Nov. 20, 2012 with Japanese and English translations.

* cited by examiner

*Primary Examiner* — Michael Dennis
(74) *Attorney, Agent, or Firm* — Rabin & Berdo, P.C.

(57) ABSTRACT

A vehicle toy makes an imagination of an appearance of a second mode which is transformable from an appearance of a first mode difficult. A vehicle toy transformable between a first mode and a second mode includes a base member having a front surface forming part of the first mode and a back surface forming part of the second mode, at least two or more rotating members each rotatably coupled to the base member and having different features on the front surfaces and the back surfaces thereof so that the front surfaces form the first mode and the back surfaces form the second mode, and have connecting portions disposed at respective ends of at least two of the rotating members connecting to each other and retain the vehicle toy in either the first mode or in the second mode.

3 Claims, 9 Drawing Sheets

VEHICLE TOY

CROSS-REFERENCE TO RELATED APPLICATION

This application claims priority to Japanese Patent Application 2009-218376, filed on Sep. 24, 2009, the entirety of which is incorporated herein by reference.

BACKGROUND OF THE INVENTION

1. Field of the Invention

The present invention relates to a vehicle toy which is transformed from a vehicle in a first mode to a vehicle in a second mode different from the first mode.

2. Description of the Related Art

A vehicle toy in the related art of a type including a plurality of members having different appearances in front surfaces and back surfaces, and being configured in such a manner that an operator rotates respective members to reverse the respective members to transform the same into a vehicle toy having another appearance is known.

For example, a vehicle toy disclosed in Japanese Unexamined Patent Application Publication No. 58-36580 includes body side walls, a body front surface, and a body rear surface attached to a supporting frame so as to be rotatable in the vertical direction. When the operator rotates the body side walls, the body front surface, and the body rear surface in the vertical direction, the appearance of the vehicle toy is transformed. A vehicle toy disclosed in Japanese Registered Utility Model No. 3047055 is designed to have designs of different vehicle types in the front and rear of a main body of the vehicle toy. A plurality of members each having different designs on a front surface and a back surface are attached to a frame at the center of the main body so as to be rotatable, so that the appearance of the vehicle toy is transformed between a case where the frame is arranged in such a manner that the plurality of members cover the front portion of the vehicle and a case where the plurality of members cover the rear portion of the vehicle.

Subsequently, problems in the related art will be described. The vehicle toy disclosed in Japanese Unexamined Patent Application Publication No. 58-36580 is adapted to transform the appearance by rotating only the body side walls, the body front surface, and the body rear surface in the vertical direction. Therefore, portions to be rotated for transforming the appearance are just part of the vehicle toy, and there is a problem that the transformation is easily imaginable. A vehicle toy disclosed in Japanese Registered Utility Model No. 3047055 is adapted to transform the type of the vehicle by arranging a plurality of members so as to overlap with a front or rear portion of the vehicle toy, and hence steps are formed on the front portion and the rear portion of the vehicle toy by an extent corresponding to the thickness of the members which cover the main body.

SUMMARY OF THE INVENTION

Accordingly, it is an object of the invention to provide a vehicle toy whose appearance after transformation is difficult to imagine based on its initial appearance.

In order to solve the above-described problems, a vehicle toy according to the invention is a vehicle toy transformed between a first mode and a second mode that includes a base member having a front surface which constitutes part of the first mode and a back surface which constitutes part of the second mode; and at least two or more rotating members each being rotatably coupled to the base member and having different designs on the front surface and the back surface so that the front surface produces the first mode and the back surface produces the second mode, and characterized in that at least two of the two or more rotating members have connecting portions at respective ends thereof so as to be connected to each other and retain the vehicle toy in the first mode or in the second mode, and the back surface of the base member is covered with the two or more rotating members and hence is in an invisible state when the vehicle toy is in the first mode.

The expression "invisible state" in the invention includes not only a state of being invisible completely from the outside as a matter of course, but also a state of being invisible to an extent which resists imagination of the second mode.

The vehicle toy according to the invention is characterized in that the connecting portion employs a magnet to connect the rotating members with respect to each other.

The vehicle toy according to the invention is characterized in that an operating portion provided on the rotating member to allow an operator to rotate in the direction of rotation of the rotating member to rotate the rotating member; and a locking portion provided on the rotating member which is different from the rotating member provided with the operating portion for allowing the operating portion to be locked therewith.

The vehicle toy according to the invention is characterized in that the base member is provided with a wheel of the vehicle toy.

The vehicle toy according to the invention is characterized in that a peripheral surface of the wheel projects from the front surface and the back surface of the base member.

The vehicle toy according to the invention is characterized in that the base member is a member which constitutes a front end portion of the vehicle toy.

The vehicle toy according to the invention is characterized in that at least one of the two or more rotating members is provided with the wheel of the vehicle toy. The vehicle toy according to the invention is characterized in that the wheel projects from the front surface and the back surface of the rotating member having the wheel provided thereon.

According to the vehicle toy in the invention, a vehicle toy is of a form such that imagination of an appearance of a second mode into which the vehicle toy is transformable from a first mode is difficult based on an appearance of the vehicle toy in the first mode.

DESCRIPTION OF THE PREFERRED EMBODIMENTS

Referring now to drawings, preferred embodiments of the invention will be described in detail.

Figure 1:
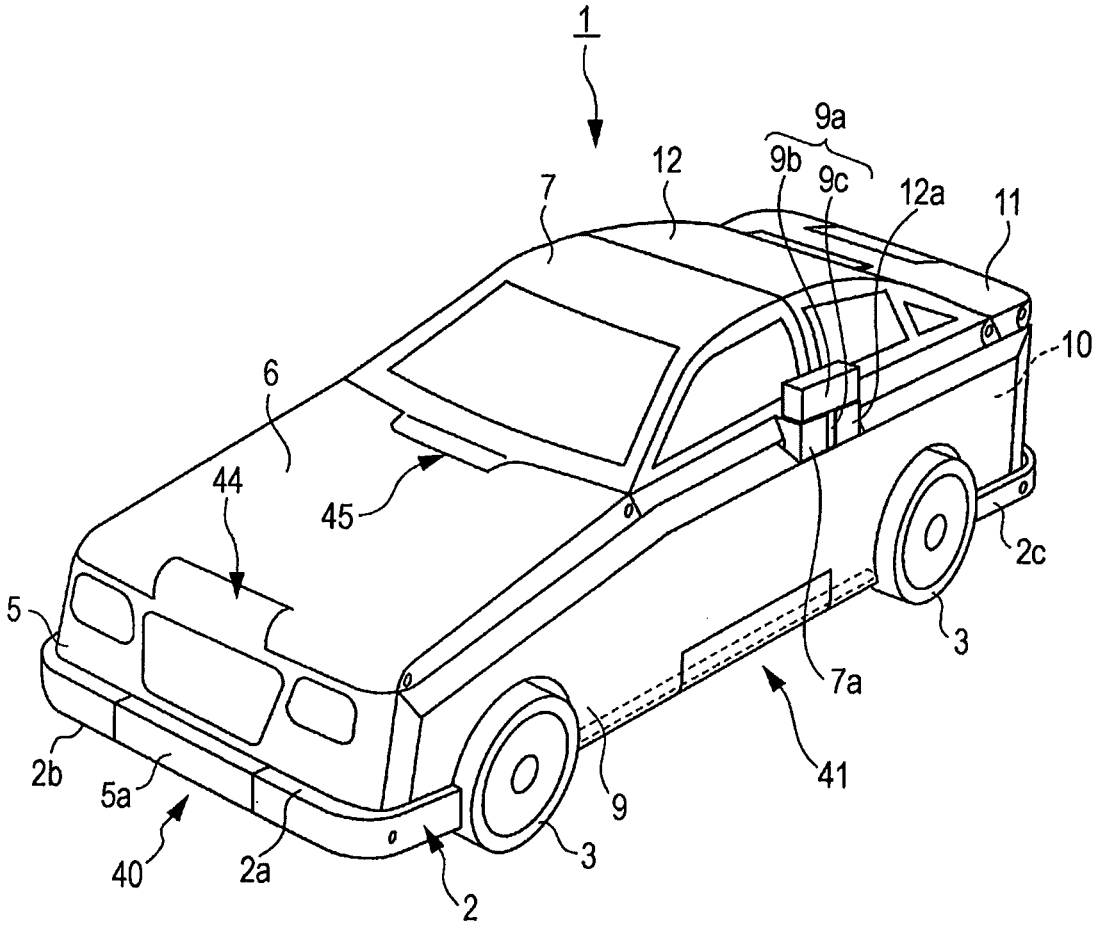
FIG. 1 is a perspective view showing a first mode of a vehicle toy appearing as a general passenger car according to a first embodiment.
Figure 2:
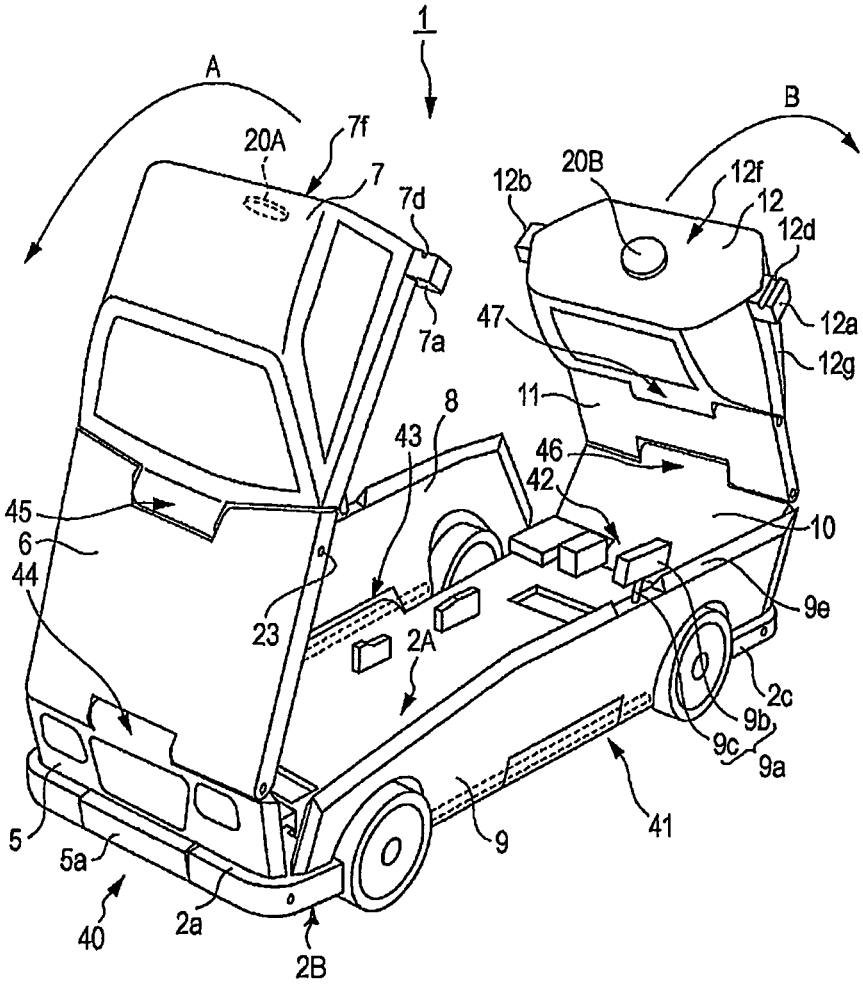
FIG. 2 is a perspective view of the vehicle toy in FIG. 1 showing an initial stage of transformation from the first mode to a second mode appearing as a patrol car.

FIG. 1 is a perspective view of as a first mode of a vehicle toy appearing as a general passenger car according to a first embodiment. FIG. 2 is a perspective view of the vehicle toy in FIG. 1 showing an initial stage of transformation from the first mode to a second mode appearing as a patrol car.

As shown in FIG. 1 and FIG. 2, a vehicle toy 1 includes a chassis 2, wheels 3, a body front surface 5, a hood 6, a front side cabin 7, a side wall 8, a side wall 9, a body rear surface 10, a trunk 11, and a rear side cabin 12. Here, the chassis 2 and the wheels 3 are together a base member. The body front surface 5, the hood 6, the front side cabin 7, the side wall 8, the side wall 9, the body rear surface 10, the trunk 11, and the rear side cabin 12 are each rotating members. These members may be formed of general resin. A front surface 2B of the chassis 2 is a bottom surface of the general passenger car in the first mode, and a back surface 2A opposite to the front surface 2B is the bottom surface of the patrol car in the second mode. The body front surface 5, the hood 6, the front side cabin 7, the body rear surface 10, the trunk 11, the rear side cabin 12, the side wall 8, and the side wall 9 have appearances of the general passenger car in the first mode on the front surfaces thereof, and have appearances of the patrol car in the second mode on the back surfaces thereof.

The back surface 2A of the chassis 2 is covered by the body front surface 5, the hood 6, the front side cabin 7, the side wall 8, the side wall 9, the body rear surface 10, the trunk 11, and the rear side cabin 12 when appearing as the general passenger car in the first mode so as not to be visible from the outside to an extent preventing an imagination of the second mode. Thus, when the vehicle toy is in the first mode, the second mode is in the invisible state, and vice versa. The back surfaces of the chassis 2, the body front surface 5, the hood 6, the front side cabin 7, the body rear surface 10, the trunk 11, the rear side cabin 12, the side wall 8, and the side wall 9, which together produce the appearance of a patrol car in the second mode, are configured so as not to be visible from the outside when in the vehicle toy appears as the general passenger car in the first mode. The front surfaces, which together produce the first mode, do not depend on the appearances provided on the back surfaces thereof, and the appearance of the vehicle toy as a patrol car in the second mode is difficult to imagine from the appearance of the vehicle toy as a general passenger car in the first mode. The body front surface 5, the hood 6, the front side cabin 7, the side wall 8, the side wall 9, the body rear surface 10, the trunk 11, and the rear side cabin 12 (rotating members), which together form a body of the vehicle toy, rotate with respect to the chassis 2 provided with the wheels 3 (the base member), and the appearance of the body, which comprises a large portion of the vehicle toy, is transformed. Hence, the operator cannot imagine the transformation easily.

The body front surface 5, the body rear surface 10, the side wall 8, and the side wall 9 are each rotatably coupled to four sides of the chassis 2 respectively via hinge portions 40, 42, 43 and 41. The body front surface 5, the hood 6, and the front side cabin 7 are rotatably coupled to each other via hinge portions 44 and 45. The body rear surface 10, the trunk 11, and the rear side cabin 12 are rotatably coupled to each other via hinge portions 46 and 47.

End portions of the body front surface 5, the hood 6, the front side cabin 7, the body rear surface 10, the rear side cabin 12, the side wall 8, and the side wall 9, which come into contact with each other, are formed into a chevron shape. For example, as shown in FIG. 2, portions where the side wall 9 and the rear side cabin 12 come into contact with each other, an end portion 9*e* of the side wall 9 and a left side end portion 12*g* of the rear side cabin 12 are formed into the chevron shape so that the inner inclined surface of the end portion 9*e* of the side wall 9 and the lower inclined surface of the left side end portion 12*g* of the rear side cabin 12 come into contact with each other.

An end portion 7*f* of the front side cabin 7 is provided with a magnet 20A so as to be depressed about 1 mm from the front surface of the end portion 7*f*. An end surface 12*f* of the rear side cabin 12 is provided with a metallic part 20B projecting on the order of 1 mm from the end surface 12*f* of the rear side cabin 12 at a position corresponding to the magnet 20A. The magnet 20A and the metallic part 20B together form a connecting portion. In this configuration, connection and disconnection are achieved easily without impairing the appearance of the vehicle toy, and the mode of the vehicle toy is reliably retained.

The rear portion of the front side cabin 7 includes locking strips 7*a* and 7*b* disposed on left and right side surfaces thereof. The locking strips 7*a* and 7*b* are formed with groove portions 7*d* and 7*e* on rear side surfaces thereof so as to extend in the vertical direction. The front portion of the rear side cabin 12 similarly includes locking strips 12*a* and 12*b* respectively so as to corresponding to the locking strips 7*a* and 7*b* on the left and right side surfaces thereof. The locking strips 12*a* and 12*b* are formed with groove portions 12*d* and 12*e* on front side surfaces thereof so as to extend in the vertical direction. In this embodiment, a pair of the locking strip 7*a* and the locking strip 12*a*, and a pair of the locking strip 7*b* and the locking strip 12*b* respectively form locking portions on either side of the vehicle toy.

An operating portion 9*a* is provided at an upper end portion of the side wall 9, and the operating portion 9*a* includes a support 9*c* and a tab 9*b* provided at an end of the support 9*c*. In the same manner, an operating portion 8*a* including a support 8*c* and a tab 8*b* are provided at the upper end portion of the side wall 8 as well. The operating portions 8*a* and 9*a* allow the operator to rotate the side walls 8 and 9, that is, the rotating members easily. Also, since the operating portions 8*a* and 9*a* are locked with the locking strips 7*a* and 7*b* and the locking strips 12*a* and 12*b* of the front side cabin 7 and the rear side cabin 12, respectively, as other rotating members, the rotating members (side walls 8, 9) provided with the operating members 8*a*, 9*a* are stably fixed.

Figure 3:
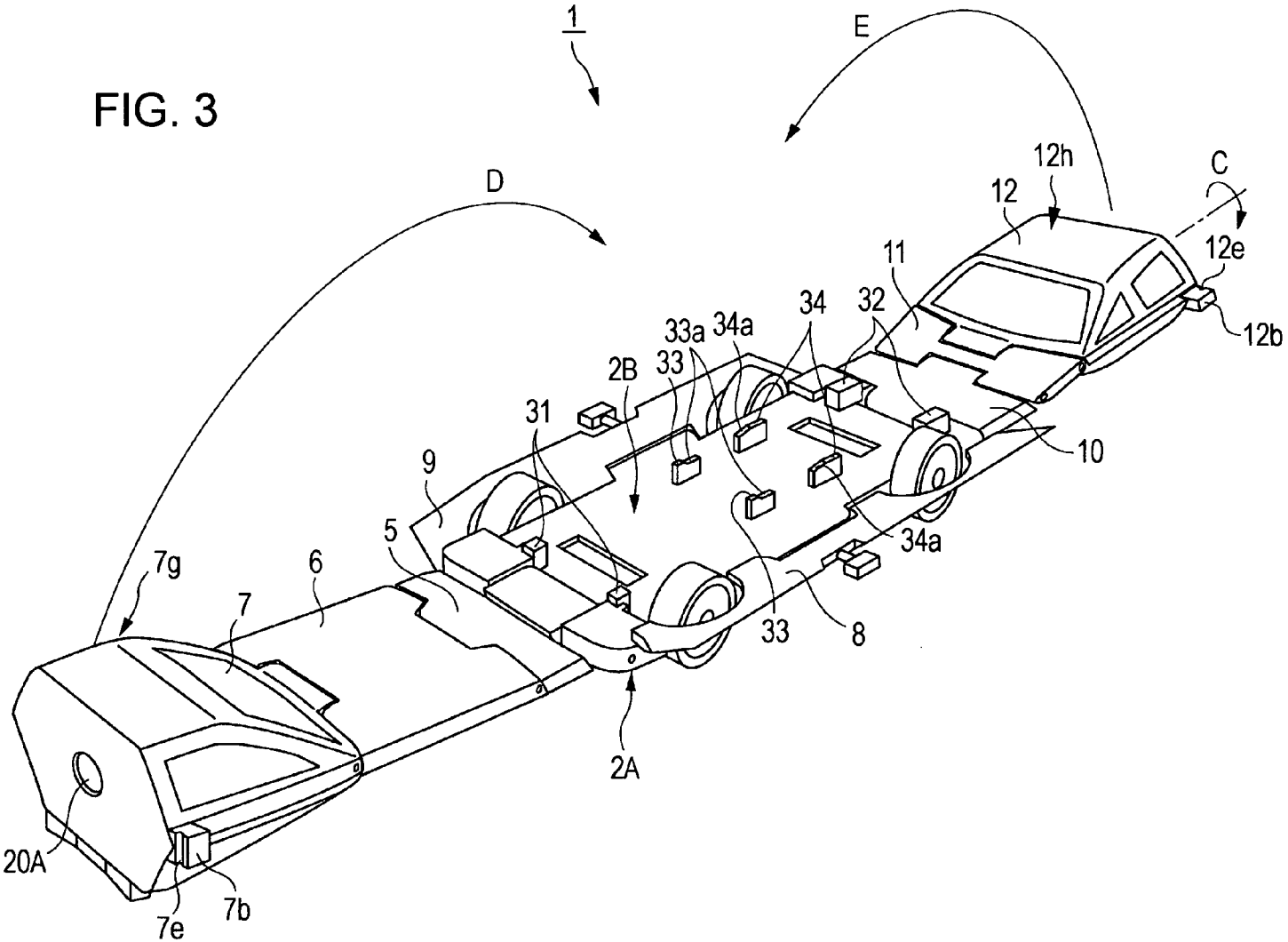
FIG. 3 is a perspective view of the vehicle toy in FIG. 1 showing an intermediate stage of transformation from the first mode to the second mode.

FIG. 3 is a perspective view of the vehicle toy in FIG. 1 showing an intermediate stage of transformation of the vehicle toy from the first mode to the second mode.

The front surface 2B and the back surface 2A of the chassis 2 are each formed with projecting portions 31 for positioning the body front surface 5. Projecting portions 32, ribs 33, and ribs 34 similarly support other rotating members.

The projecting portions 31 are provided so that the body front surface 5 comes into contact with the projecting portions 31 when the body front surface 5 is rotated in a direction D (that is, rotated in the direction toward the front surface 2B of the chassis 2). The ribs 33 projecting upright near the center of the chassis 2 are provided so that top portions of the ribs 33 come into contact with the front side cabin 7 when the front side cabin is rotated in the direction D. The top portions of the ribs 33 are each formed with a step 33*a* into a form corresponding to a curved portion 7*g* of the front side cabin 7.

The projecting portions 32 are provided so that the body rear surface 10 comes into contact with the projecting portion 32 when the body rear surface 10 is rotated in a direction E (that is, in the direction toward the front surface 2B of the chassis 2) in a similar manner to the projecting portion 31. The ribs 34 are provided so that the top portions of the ribs 34 abut a roof portion 12*h* of the rear side cabin 12 when the rear side cabin 12 is rotated in the direction E in a similar manner to the rib 33. The top portions of the ribs 34 each are formed with inclined surfaces 34*a* so as to allow the positioning of the rear side cabin 12 at a predetermined angle.

Figure 4:
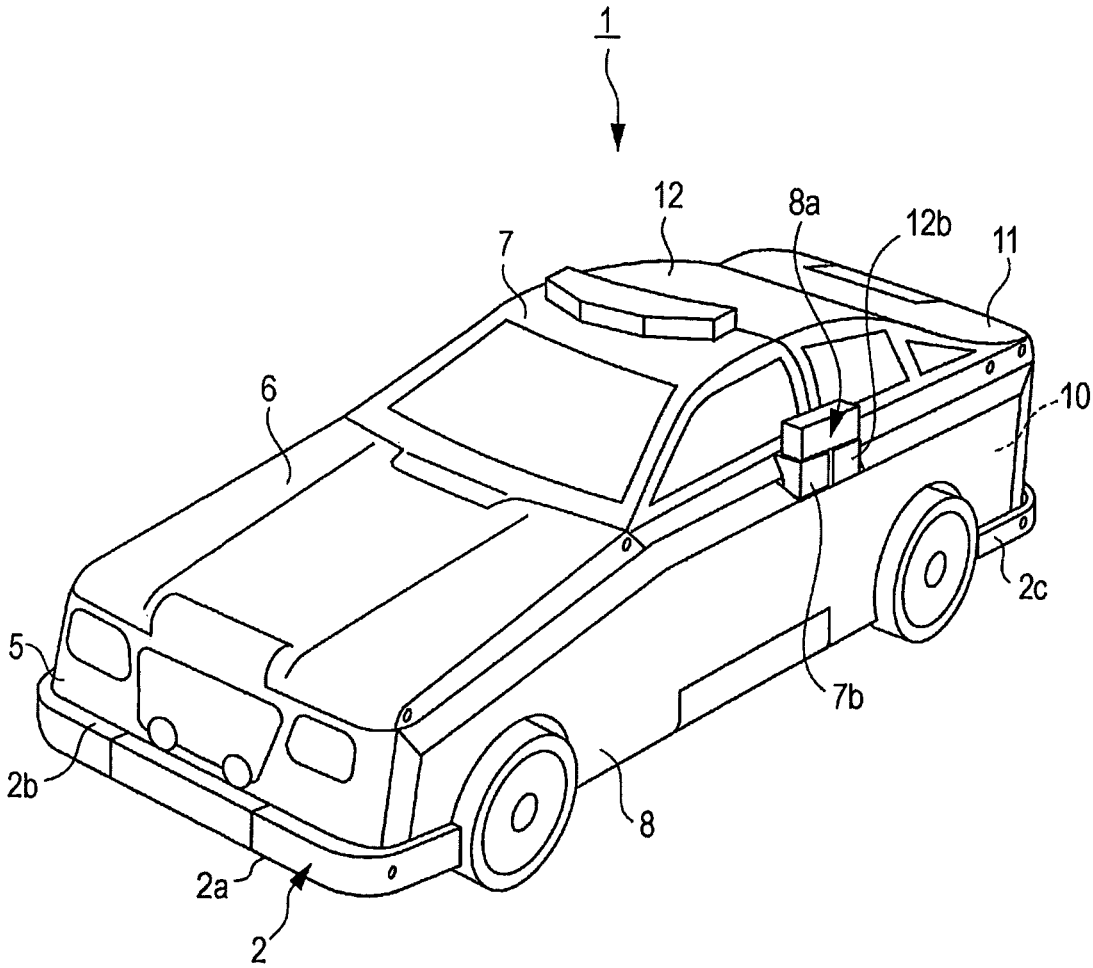
FIG. 4 is a perspective view of the vehicle toy in FIG. 1 showing a completed state of transformation into the second mode.

FIG. 4 is a perspective view of the vehicle toy in FIG. 1 showing a completed state of transformation into the second mode. Even when having transformed into the patrol car second mode, the basic configuration is not changed except that the left and right of the vehicle toy 1 are inverted. The hood 6 and the front side cabin 7 are rotatably coupled to the body front surface 5, rotatably coupled to a front end portion 2*a* of the chassis 2. The trunk 11 and the rear side cabin 12 are further rotatably coupled to the body rear surface 10, which is itself rotatably coupled to a rear end portion 2*c* of the chassis 2. The front side cabin 7 and the rear side cabin 12 are stuck to each other by the magnet 20A and the metallic part 20B.

The side wall 8 and the side wall 9 are rotatably coupled to side end portions of the chassis 2. The operating portion 8*a* is placed between the locking strip 7*b* and the locking strip 12*b*, and the operating portion 9*a* is similarly placed between the locking strip 7*a* and the locking strip 12*a*.

When transforming the mode of the vehicle toy 1 from the first general passenger car mode to the second patrol car mode, the operating portion 8*a* and the operating portion 9*a* are firstly taken between the fingers from the state in FIG. 1 and the side wall 8 and the side wall 9 are rotated outward. Then, the front side cabin 7 and the rear side cabin 12 are held, the body front surface 5, the hood 6, and the front side cabin 7 are rotated in a direction A (direction away from the back surface 2A of the chassis 2) and the body rear surface 10, the trunk 11, and the rear side cabin 12 are rotated in a direction B (direction away from the back surface 2A of the chassis 2) against an attractive force between the magnet 20A and the metallic part 20B, and are separated as shown in FIG. 2.

Subsequently, the side wall 8, the side wall 9, the body front surface 5, the hood 6, the front side cabin 7, the body rear surface 10, the trunk 11, and the rear side cabin 12 are rotated and developed the same as shown in FIG. 3.

Then, the vehicle toy 1 is rotated and reversed in a direction C, around an axis running along the length of the vehicle toy. Then, the body front surface 5, the hood 6, and the front side cabin 7 are rotated in a direction D, and the body rear surface 10, the trunk 11, and the rear side cabin 12 are rotated in a direction E to cause the magnet 20A and the metallic part 20B to stick to each other. Here, since a head of the metallic part 20B fits into a depression formed by the magnet 20A, occurrence of misalignment of the front side cabin 7 and the rear side cabin 12 in the lateral direction and the vertical direction is restrained.

Subsequently, the side walls 8 and 9 are rotated toward the front surface 2B of the chassis 2 to place the operating portion 8*a* provided at the upper end portion of the side wall 8 interposed between the locking strip 7*b* and the locking strip 12*b* to fix the side wall 8. The operating portion 9*a* provided at the upper end portion of the side wall 9 is interposed between the locking strip 7*a* and the locking strip 12*a* to fix the side wall 9. Accordingly, transformation from the general passenger car to the patrol car shown in FIG. 4 is completed.

Similar operation to the procedure described above may be performed to transform the vehicle toy 1 from the state of the patrol car to the state of the general passenger car, so that the operator can transform the appearance easily.

The wheels 3 are provided on the chassis 2 so that peripheral surfaces thereof project from the front surface 2B and the back surface 2A of the chassis 2. Therefore, the wheels 3 can be used commonly in the vehicle toy appearing as the general passenger car in the first mode and the vehicle toy appearing as the patrol car in the second mode, so that the simple structure of the vehicle toy and the transformation of the mode are achieved simultaneously.

Figure 5:
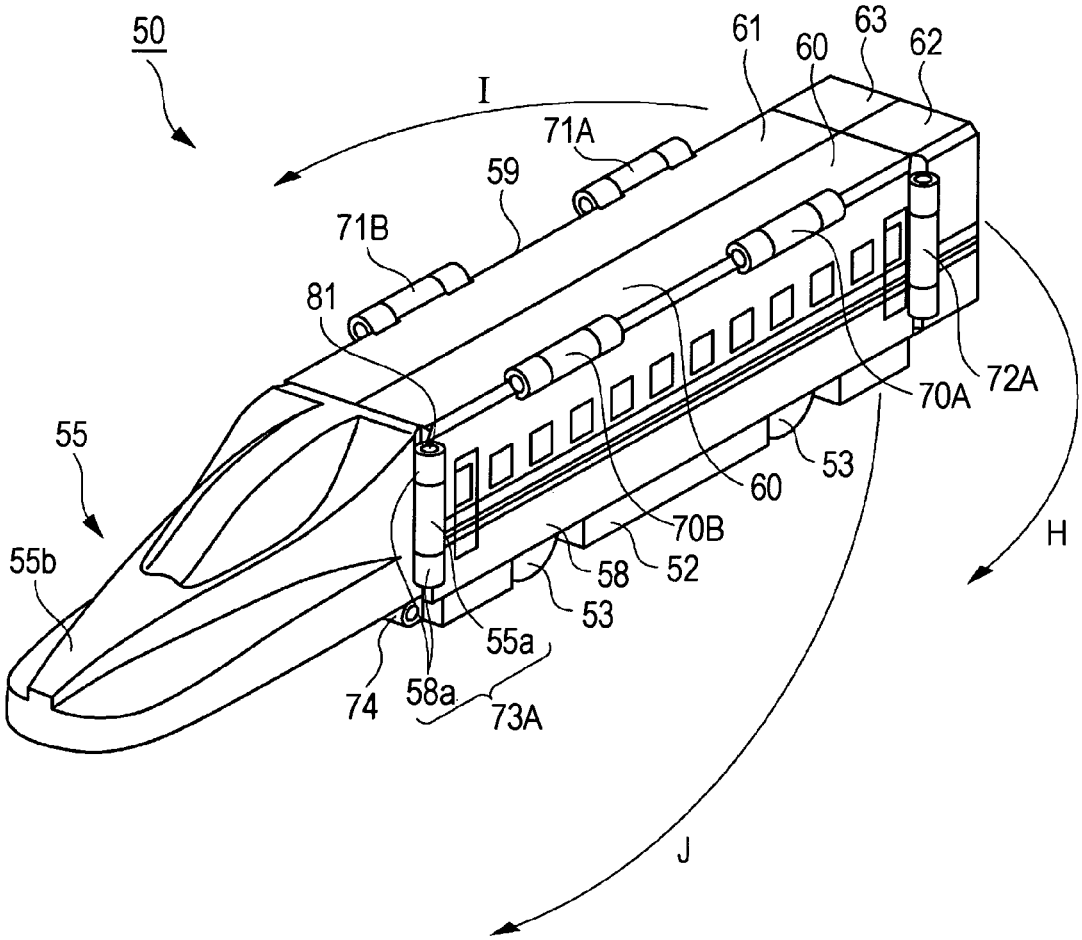
FIG. 5 is a perspective view showing a first mode of the vehicle toy appearing as a super-express train according to a second embodiment.

FIG. 5 is a perspective view showing a vehicle toy appearing as a super-express train in a first mode of the vehicle toy according to a second embodiment. In an example on the basis of FIG. 1 to FIG. 4, element corresponding to the front side cabin 7, the side walls 8 and 9, and so on are illustrated to be rotated at an angle of 180° about the chassis 2 to transform the appearance in the first embodiment. In this embodiment, a chassis 52 and side walls 58 and 59 are rotated about a body front surface 55 forming the front end portion of the vehicle toy to transform the appearance of the toy into the second mode.

A vehicle toy 50 includes the body front surface 55, the chassis 52 including wheels 53, the side wall 58, the side wall 59, a holding portion 62, a holding portion 63, a left side roof portion 60, and a right side roof portion 61. Here, the body front surface 55 constitutes the base member in the invention. The chassis 52 including the wheels 53, the side wall 58, the side wall 59, the holding portion 62, the holding portion 63, the left side roof portion 60, the right side roof portion 61 are each rotating members. The front surfaces of the side wall 58, the side wall 59, the holding portion 62, the holding portion 63, the left side roof portion 60, and the right side roof portion 61 are designed to have an appearance of the super-express train, and the back surfaces of the same are designed to have an appearance of a local train. In addition, a front surface 55*b* of the body front surface 55 is formed to have the shape of a front end of the super-express train in the first mode. The back surface of the body front surface 55, being formed to have an appearance of the front surface of the local train in the second mode, is covered with the side wall 58, the side wall 59, the holding portion 62, the holding portion 63, the left side roof portion 60, the right side roof portion 61 so as not to be visible from the outside to an extent preventing an imagination of the second mode, or the invisible state, when the vehicle toy is in the first mode of the super-express train. Since the back surfaces of each of the body front surface 55, the chassis 52 provided with the wheels 53, the side wall 58, the side wall 59, the holding portion 62, the holding portion 63, the left side roof portion 60, and the right side roof portion 61, together producing the local train in the second mode, are invisible from the outside when in the vehicle toy is in the first mode appearing a the super-express train, the front surfaces producing the first mode do not depend on the appearances provided on the back surfaces thereof, and the appearance of the local train in the second mode is difficult to imagine from the appearance of the super-express train in the first mode. In addition, since only one of the front surface and the back surface of the body front surface 55 (base member in the invention) are exposed to the outside, and the other one of those can be hidden inside the vehicle toy, completely different structures having different appearances can be provided thereon, so that the operator can hardly imagine the appearances before and after the transformation.

The chassis 52 is rotatably coupled to a rear side of a bottom portion of the body front surface 55 via a hinge portion 74. A front end portion of the side wall 58 is rotatably coupled to a rear side of a left surface of the body front surface 55 via a hinge portion 73A. A front end portion of the side wall 59 is rotatably coupled to a rear side of a right side surface of the body front surface 55 via a hinge portion 73B (see FIG. 6). The structure of hinge portion 73B will be described with the hinge portion 73A as an example. A shaft receiver 55*a* provided on the rear side of the left surface of the body front surface 55 is inserted between shaft receivers 58*a* provided at a front end portion of the side wall 58, and a shaft 81 is inserted so as to penetrate through the shaft receiver 55*a* and the shaft receivers 58*a*.

Figure 6:
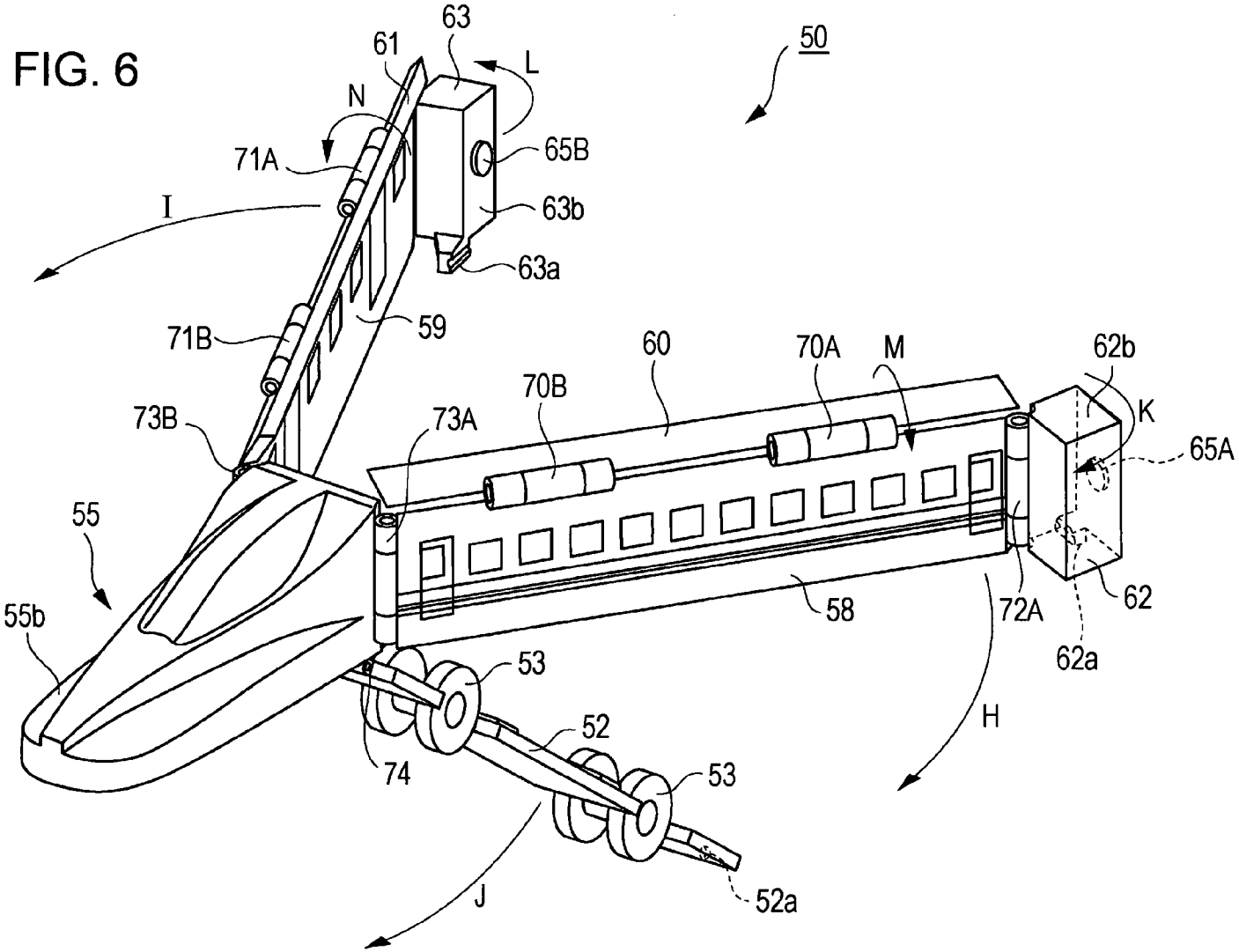
FIG. 6 is a perspective view of the vehicle toy in FIG. 5 showing an initial stage of transformation from the first mode to a second mode appearing as a local train.

The holding portion 62 is rotatably coupled to the rear end portion of the side wall 58 via a hinge portion 72A. The left side roof portion 60 is rotatably coupled to an upper end portion of the side wall 58 via hinge portions 70A and 70B. As shown in FIG. 6 described later, in the same manner as the side wall 58, the holding portion 63 is rotatably connected to the side wall 59 via the hinge portion 72B, and the right side roof portion 61 is rotatably coupled to the upper end portion of the side wall 59 via hinge portions 71A and 71B.

FIG. 6 is a perspective view of the vehicle toy in FIG. 5 showing the initial stage of transformation from the first mode to the second mode. A magnet 65A is provided on an inner side surface 62*b* of the holding portion 62, and the front surface of the magnet 65A is set to be depressed on the order of 1 mm from the inner side surface 62*b*. A metallic part 65B is provided on an inner surface 63*b* of the holding portion 63 so as to correspond to the magnet 65A, and the front surface of the head of the metallic part 65B is provided so as to project on the order of 1 mm from the inner surface 63*b*. The metallic part 65B may be formed of iron, stainless steel, or the like so as to be attracted to the magnet. In this configuration, the connection and disconnection are achieved easily without impairing the appearance, and the mode of the vehicle toy is reliably retained.

A locking strip 62*a* is provided on the lower side of the holding portion 62, and a locking strip 63*a* is provided on the lower side of the holding portion 63. The locking strip 62*a* is formed with a groove portion 62*e* in the fore-and-aft direction of the vehicle. The locking strip 63*a* is formed with a groove portion 63*e* in the fore-and-aft direction of the vehicle. A fixed portion 52*a* is provided at a rear end of the chassis 52 at a position corresponding to the locking strip 62*a* and the locking strip 63*a* so as to project rearward of the chassis 52.

Figure 7:
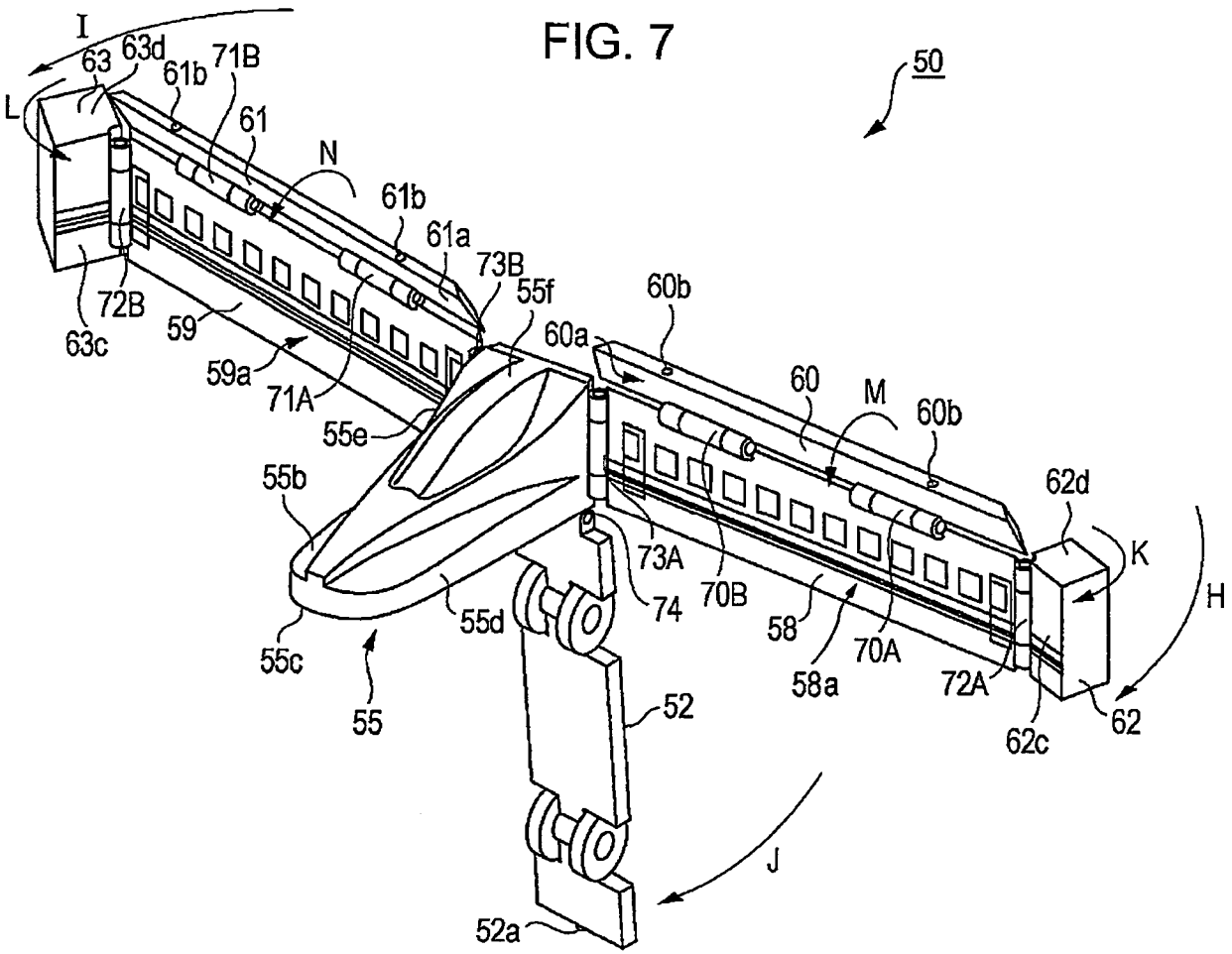
FIG. 7 is a perspective view of the vehicle toy in FIG. 5 showing an intermediate stage of transformation from the first mode to the second mode.
Figure 8:
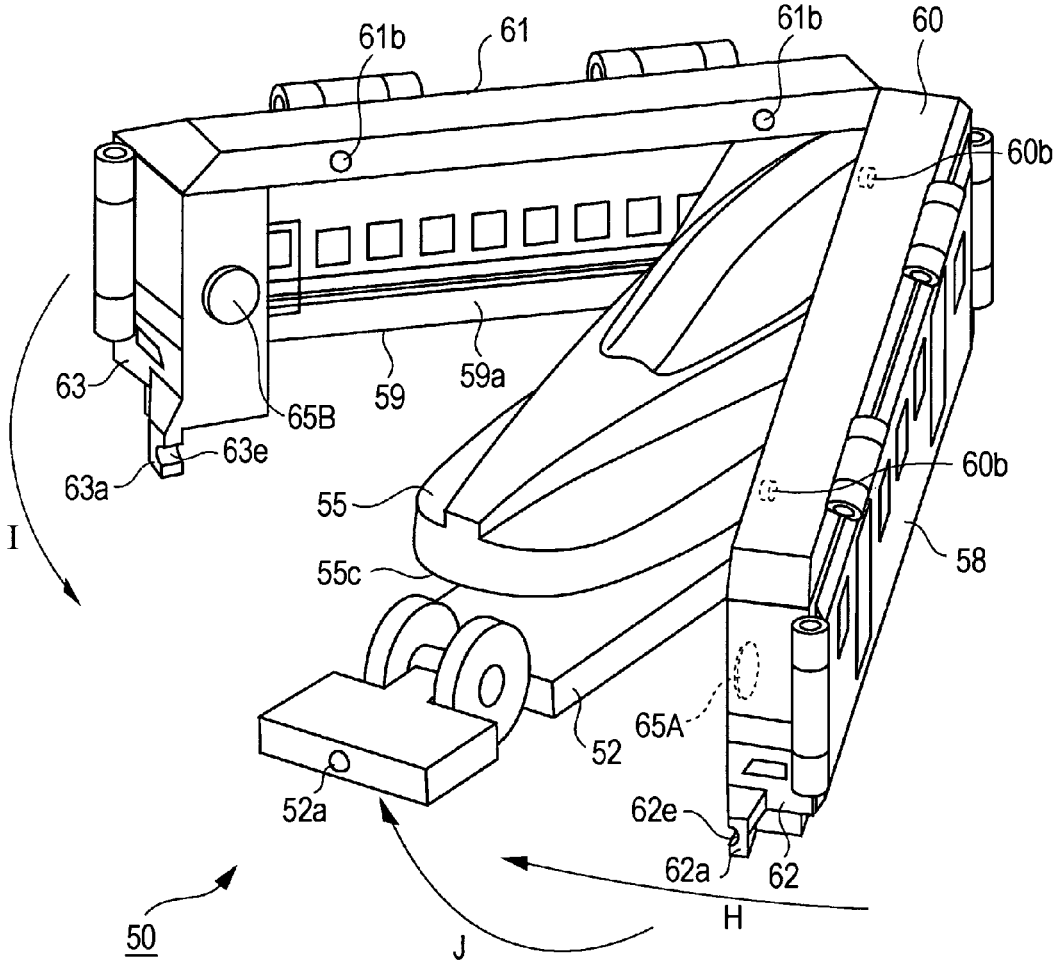
FIG. 8 is a perspective view of the vehicle toy in FIG. 5 showing a late stage of transformation from the first mode to the second mode.

FIG. 7 is a perspective view of the vehicle toy in FIG. 5 showing the intermediate stage of transformation from the first mode to the second mode. FIG. 8 is a perspective view of the vehicle toy in FIG. 5 showing a late stage of transformation from the first mode to the second mode.

As shown in FIG. 7 and FIG. 8, two depressions 60*b* are provided on a surface of the left side roof portion 60 which abuts against the right side roof portion 61. Also, two projections 61*b* are provided on a surface of the right side roof portion 61 which abuts against the left side roof portion 60 at positions corresponding to the depressions 60*b*.

Figure 9:
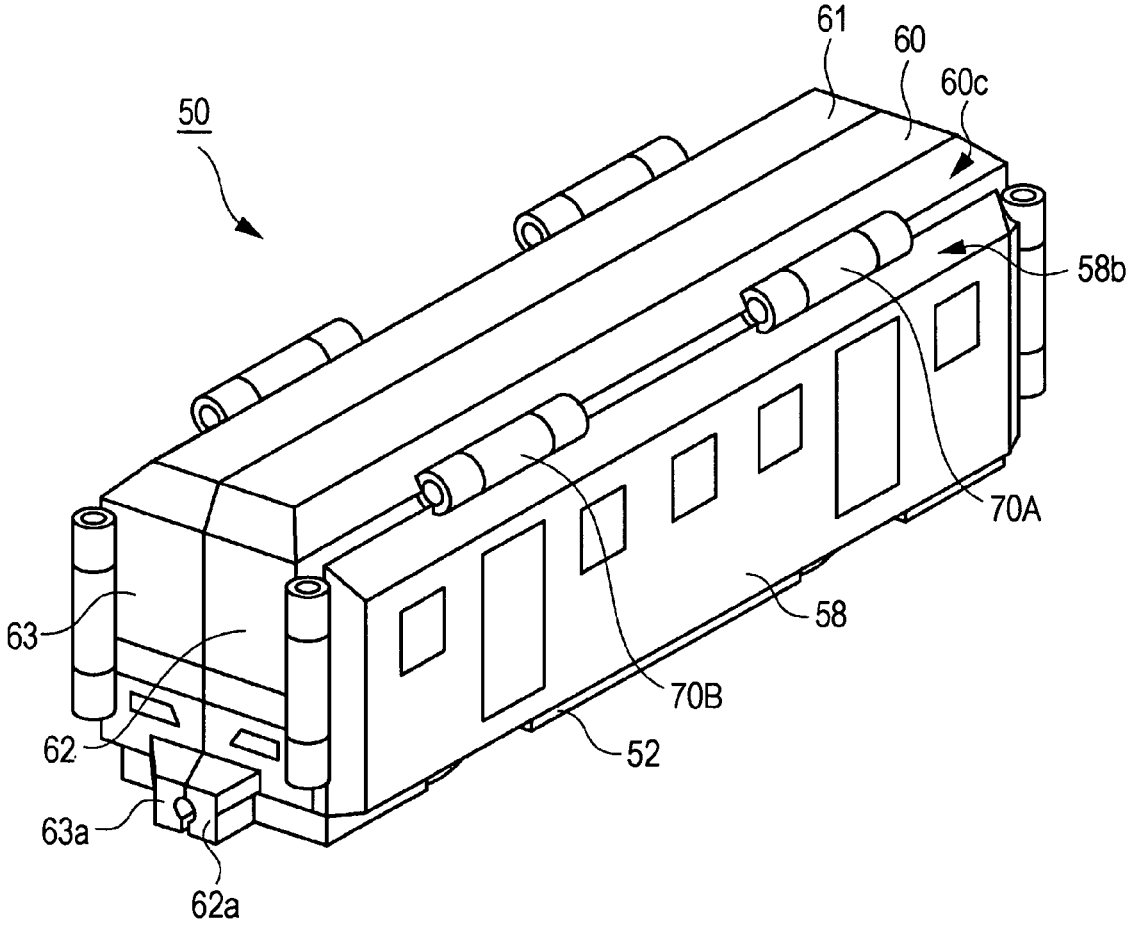
FIG. 9 is a perspective view of the vehicle toy in FIG. 5 showing a completed state of transformation into the second mode.

FIG. 9 is a perspective view of the vehicle toy in FIG. 5 showing a completed state of transformation into the local train as the second mode. As shown in FIG. 9, a tapered surface 58*b* is formed on an upper portion of the side wall 58. Also, a tapered surface 60*c* is formed on the side surface of the left side roof portion 60 as well.

When transforming the vehicle toy 50 from the first super-express train mode to the second local train mode, the holding portion 62 and the holding portion 63 are firstly held by an operator in the state illustrated in FIG. 5. The holding portion 62 and the side wall 58 are rotated in a direction H (the direction toward a left side surface 55*d* of the body front surface 55) about the hinge portion 73A as an axis of rotation, against the sticking force between the magnet 65A and the metallic part 65B, and the holding portion 63 and the side wall 59 are rotated in a direction I (the direction toward the front surface 55*b* of the body front surface 55) about the hinge portion 73B as an axis of rotation.

The locking strip 62*a* and the locking strip 63*a* here lock the fixed portion 52*a* in the state of the super-express train or the state of the local train. Therefore, when the holding portion 62 and the holding portion 63 are moved away from each other, the fixed portion 52*a* falls from between the locking strip 62*a* and the locking strip 63*a* to allow the chassis 52 to rotate about the hinge portion 74 as an axis of rotation in a direction J (the direction toward the front surface 55*b* of the body front surface 55).

Subsequently, as shown in FIG. 6 and FIG. 7, the holding portion 62 is rotated in a direction K (the direction toward the front surface 58*a* of the side wall 58) about the hinge portion 72A as an axis of rotation until the holding portion 62 comes into contact with the side wall 58. In the same manner, the holding portion 63 is rotated in a direction L (the direction toward the front surface 59*a* of the side wall 59) about the hinge portion 72B as an axis of rotation until the holding portion 63 comes into contact with the side wall 59. Also, the left side roof portion 60 is rotated in a direction M (the direction toward the front surface 58*a* of the side wall 58) about the hinge portion 70A and 70B as an axis of rotation, and the right roof portion 61 is rotated in a direction N (the direction toward the front surface 59*a* of the side wall 59) about the hinge portion 71A and 71B as an axis of rotation.

Then, as shown in FIG. 8, the side wall 58 is rotated in the direction H until the front surface 58*a* of the side wall 58 comes into contact with the left side surface 55*d* of the body front surface 55. In this manner, the operator can transform the appearance of the vehicle with ease, by rotating the holding portion 62, the left side roof portion 60, and the side wall 58 and arranging the same so that the holding portion 62, the left side roof portion 60, the side wall 58, and the body front surface 55 abut each other. Subsequently, the side wall 59 is rotated in the direction I to cause the magnet 65A and the metallic part 65B to stick to each other.

When the left side roof portion 60 and the right side roof portion 61 are brought into abutment with each other, the projection 61*b* is fitted to the depression 60*b*. Accordingly, the movement of the left side roof portion 60 in the direction opposite from the direction M is restricted, and the movement of the right side roof portion 61 in the direction opposite from the direction N. Therefore, the left side roof portion 60 and the right side roof portion 61 are prevented from easily opening upward from the vehicle while the operator is playing with the vehicle toy 50.

Subsequently, the chassis 52 is rotated in the direction J until it comes into contact with a lower front end portion 55*c* of the body front surface 55. Then, the fixed portion 52*a* is placed between the locking strip 62*a* and the locking strip 63*a*. Since the holding portion 62 and the holding portion 63 here are stuck and joined together by the magnet 65A and the metallic part 65B, when the operator rotates the chassis 52 in the direction J by exerting a certain degree of force thereon, the locking strip 62*a* and the locking strip 63*a* move away from each other against the sticking force of the magnet 65A, so that the fixed portion 52*a* can be placed easily between the locking strip 62*a* and the locking strip 63*a*.

Accordingly, the transformation to the local train shown in FIG. 9 is completed. The front surface 55*b* of the body front surface 55 is enveloped inside the side wall 58, the side wall 59, the holding portion 62, the holding portion 63, the left side roof portion 60, the right side roof portion 61, and the chassis 52, and is stored inside the vehicle so as not to be visible from the outside of the vehicle. The shape of the body front surface 55 can be set freely and the length and the shape of the transformed vehicle are not limited as long as it has sufficient length or size allowing storage of the vehicle surfaces in each of the first and second modes inside the vehicle.

Since the chassis 52, the side wall 58, the side wall 59, the holding portion 62, the holding portion 63, the left side roof portion 60, and the right side roof portion 61 are rotated at an angle of 180° about the body front surface 55, and the front surfaces having the appearance of the super-express train are all stored inside the vehicle, it is difficult to imagine that the vehicle toy is transformable into the super-express train from a visual inspection of the local train.

The wheels 53 are provided on the chassis 52 so that peripheral surfaces thereof project from the front face and the back face of the chassis 52. Therefore, the wheels 53 can be used commonly in the first super-express train as the first mode and the second local train mode, so that the simple structure of the vehicle toy and the transformation of the mode are achieved simultaneously.

The tapered surface 58*b* and the tapered surface 60*c* allow the upper portion of the side wall 58 and the side surface portion of the left side roof portion 60 to not interfere with each other when the vehicle toy 50 is in the super-express train mode. Therefore, the left side roof portion 60 can be rotated about the hinge portion 70A and 70B as an axis of rotation to expose the front surface and the back surface easily. The tapered surface 58*b* and the tapered surface 60*c* are formed also by way of design of the local train.

Although the preferred embodiments of the invention have been described herein, the vehicle toy according to the invention is not limited thereto, and various modifications and improvements are possible within the scope described in appended claims. Although the embodiments described above include the magnet and the metallic parts formed of iron or stainless steel, the invention is not limited thereto and two magnets may be used to cause the same to stick to each other.

Although two each of the projecting portions 31, the projecting portions 32, the ribs 33, and the ribs 34 are provided on one surface of the chassis 2 in the embodiments described above, the invention is not limited thereto, and a configuration in which more or less of each of the projecting portion 31, the projecting portion 32, the rib 33, and the rib 34 may be provided. Also, these elements may be provided only at positions where positioning is required.

Although the transformation between the vehicle types that are significantly different from each other in shapes of the front side cabin 7 and the body front surface 55 have been described in the embodiments describe above, the invention is not limited thereto, and designs relating to the shape of the side walls and the shape of the holding portions are flexible within a range in which the appearances is stored in the interior of the vehicle when the vehicle type is changed may also be understood within the scope of the invention.

The vehicle toy according to the embodiments described above is not limited to a transformation in vehicle type in the same procedure as in the embodiments, and the vehicle type may be transformed arbitrarily by rotating the rotating members.

Although the vehicle toy according to the embodiments described above includes the magnet and the metallic part as the connecting portion, the invention is not limited thereto and the rotating members may be connected by locking with respect to each other or by using VELCRO or the like.

Although the vehicle toy according to the invention is formed of resin, the invention is not limited thereto, and may be formed of metal or wood.

What is claimed is:

1. A vehicle toy transformable between a first mode and a second mode, comprising:

a chassis having a front surface that constitutes a bottom surface of the first mode and a back surface that constitutes a bottom surface of the second mode;

a body front surface rotatably coupled to a front end portion of the chassis, and having different appearances on a front surface and a back surface thereof so that the front surface produces the first mode and the back surface produces the second mode;

a body back surface rotatably coupled to a rear end portion of the chassis, and having different appearances on a front surface and a back surface thereof so that the front surface produces the first mode and the back surface produces the second mode;

a pair of side walls each rotatably coupled to a side end portion of the chassis, and having different appearances on a front surface and a back surface so that the front surface produces the first mode and the back surface produces the second mode; and a rotating member configured to be rotatable with respect to at least one of the body front surface and the body back surface, and having different appearances on a front surface and a back surface thereof so that the front surface produces the first mode and the back surface produces the second mode; wherein the side walls include operating portions at upper end portions thereof to allow the side walls to be rotated in a direction toward the front surface of the chassis when the mode is changed from the first mode to the second mode, and the operating portions are configured to retain the vehicle toy in the first mode or the second mode by being locked with the rotating member;

the back surface of the chassis is in an invisible state by being covered by the body front surface, the body back surface, the pair of side walls, and the rotating member when the vehicle toy is in the first mode; and the chassis is provided with a wheel of the vehicle toy, and a peripheral surface of the wheel projects from the front surface and the back surface of the chassis.

2. A vehicle toy transformable between a first mode and a second mode, comprising:

a body front surface having a front surface that constitutes a front surface of the first mode and a back surface that constitutes a front surface of the second mode;

a chassis rotatably coupled to the body front surface, and having different appearances on a front surface and a back surface thereof so that the front surface produces the first mode and the back surface produces the second mode;

a pair of side walls each rotatably coupled to the body front surface, and having different appearances on a front surface and a back surface thereof so that the front surface produces the first mode and the back surface produces the second mode; and a holding portion rotatably coupled to at least one of the pair of side walls, and having different appearances on a front surface and a back surface thereof so that the front surface produces the first mode and the back surface produces the second mode;

a roof portion rotatably coupled to at least one of the pair of side walls, and having different appearances on a front surface and a back surface thereof so that the front surface produces the first mode and the back surface produces the second mode; wherein the chassis includes a fixed portion at a rear end portion thereof to allow the chassis to be rotated in a direction toward the front surface of the body front surface when the mode is changed from the first mode to the second mode, and the fixed portion is configured to retain the vehicle toy in the first mode or the second mode by being locked with the holding member;

the back surface of the body front surface is in an invisible state by being covered by the chassis, the holding portion, the pair of side walls, and the roof portion when the vehicle toy is in the first mode; and the chassis is provided with a wheel of the vehicle toy, and a peripheral surface of the wheel projects from the front surface and the back surface of the chassis.

3. A vehicle toy transformable between a first mode and a second mode, comprising:

a chassis having a front surface that constitutes a bottom surface of the first mode and a back surface that constitutes a bottom surface of the second mode;

a body front surface rotatably coupled to a front end portion of the chassis, and having different appearances on a front surface and a back surface thereof so that the front surface produces the first mode and the back surface produces the second mode;

a body back surface rotatably coupled to a rear end portion of the chassis, and having different appearances on a front surface and a back surface thereof so that the front surface produces the first mode and the back surface produces the second mode;

a pair of side walls each rotatably coupled to a side end portion of the chassis, and having different appearances on a front surface and a back surface so that the front surface produces the first mode and the back surface produces the second mode; and a rotating member configured to be rotatable with respect to at least one of the body front surface and the body back surface, and having different appearances on a front surface and a back surface thereof so that the front surface produces the first mode and the back surface produces the second mode; wherein the side walls include operating portions at upper end portions thereof to allow the side walls to be rotated in a direction toward the front surface of the chassis when the mode is changed from the first mode to the second mode;

the back surface of the chassis is in an invisible state by being covered by the body front surface, the body back surface, the pair of side walls, and the rotating member when the vehicle toy is in the first mode; and the chassis is provided with a wheel of the vehicle toy, and a peripheral surface of the wheel projects from the front surface and the back surface of the chassis.

* * * * *